United States Patent [19]

Odawara

[11] Patent Number: 4,796,422

[45] Date of Patent: Jan. 10, 1989

[54] APPARATUS FOR TREATING TAIL YARN IN TEXTILE SPINDLE ASSEMBLY

[75] Inventor: Kunimitsu Odawara, Hirosima, Japan

[73] Assignee: Odawara Industry Co., Ltd., Hirosima, Japan

[21] Appl. No.: 194,886

[22] Filed: May 17, 1988

[30] Foreign Application Priority Data

May 26, 1987 [JP] Japan ..... 62-130632
Dec. 20, 1987 [JP] Japan ..... 62-333155

[51] Int. Cl.[4] ..... D01H 1/38; D01H 1/40; D01H 9/16

[52] U.S. Cl. ..... 57/299; 57/303; 242/18 EW

[58] Field of Search ..... 57/299, 300, 303, 304, 57/305; 242/18 PU, 18 EW

[56] References Cited

U.S. PATENT DOCUMENTS 3,154,907 11/1964 Fisher ..... 57/303
3,210,922 10/1965 Winter ..... 57/303 X
3,339,356 9/1967 Nikel et al. ..... 57/299
3,359,714 12/1967 Sanders ..... 57/303
3,768,242 10/1973 Angst et al. ..... 57/303
3,967,440 7/1976 Narumi et al. ..... 242/18 EW X
4,050,227 9/1977 Berend ..... 57/303
4,208,865 6/1980 Koella ..... 57/303
4,598,540 7/1986 Gaudino ..... 242/18 EW X
4,617,791 10/1986 Lousberg ..... 57/299

*Primary Examiner*—John Petrakes
*Attorney, Agent, or Firm*—Burgess, Ryan & Wayne

[57] ABSTRACT

Disclosed is an apparatus for treating tail yarns in textile spindle assemblies of textile spinning machines, twisters or the like, wherein a stationary upper slit ring and an axially slidable lower slit ring are mounted on a base portion of a spindle to form a tail yarn gripping means. The pressed state of the tail yarn gripping means is released by sliding the lower slit ring downward by rotational centrifugal force. The tail yarn can be securely fixed to the tail yarn gripping means and the yarn underwindings can be automatically removed from the tail yarn gripping means during the operation of the machine.

When a flange of the upper slit ring is perforated with a plurality of yarn passing openings, the tail yarn released from the means for holding the yarn underwindings is retained by this yarn passing opening, which prevents adverse effects to the traveler in the early stage of winding, resulting in prevention of the occurrence of yarn breakage or the deterioration of yarn properties.

4 Claims, 5 Drawing Sheets

APPARATUS FOR TREATING TAIL YARN IN TEXTILE SPINDLE ASSEMBLY

BACKGROUND OF THE INVENTION

This invention relates to an apparatus for treating tail yarns in textile spindle assemblies of textile spinning machines, twisters or the like.

In textile spinning machines, twisters or the like equipped with auto-doffers by which the whole yarn packages mounted on the spindle assemblies are simultaneously doffed, in order to conduct automatically the doffing operation for changing the completed yarn packages to the empty bobbins, it is necessary to separate each yarn interconnecting the completed yarn package and the spindle assembly, and to pull the completed yarn packages out of the spindle assemblies, while maintaining the state in which each yarn fed from the roller part of the spinning machine is interconnected with the spindle assembly through the traveler.

For this purpose, Japanese Preliminary Patent Publication No. 60-134032/1985 proposes an apparatus comprising a base portion of a spindle on which a knurled surface is formed for fixedly wrapping a tail yarn thereon to form yarn underwindings and a cutter assembly movably mounted for separating an interconnecting yarn formed between the yarn underwindings and a portion of a bobbin where the yarn is firstly wrapped, the interconnecting yarn being separated by said cutter assembly and the yarn underwindings wrapped 4 to 5 turns on the knurled surface formed on the base portion of the spindle being cast off by rotational centrifugal force of the spindle.

According to this apparatus, however, the yarn underwindings can not be completely cast off for removal by rotational centrifugal force of the spindle. This causes further wrapping of new underwindings on the residual underwindings. As a result, the fixing effect of the yarn underwindings by the knurled surface is lost, which permits the yarn underwindings to move by a slight external force only. If it happens that the yarn underwinding move by a slight force, the yarn underwindings are loosened on rising of a ring rail to a position where the yarn is wound on the bobbin, which causes the disordered position of a traveler. Consequently, the yarn breakage is liable to occur at the start of the operation. Further the free end of the yarn underwindings is easily entangled with the yarn which is being wound on the bobbin at the re-start of the machine, which causes the yarn breakage and the occurrence of fluffs. Conventionally, in order to eliminate such inconvenience, the yarn underwindings have been periodically manually removed by use of a cutter or the like while the machine is stopped. However, such a conventional method is reduced in operation efficiency of the machine, because the operation is complex, labor intensive and time-consuming.

U.S. Pat. No. 4,208,865 discloses a clearer which separates the length of yarn interconnecting yarn underwindings with a yarn package and blow away the yarn underwindings by blasts of air. Since this clearer is actuated at the same time that the operation of the machine is initiated, the blown-away yarn underwindings are entangled with the yarn which is being wound on the bobbin, which causes yarn breakage and the occurrence of fluffs.

Further, Japanese Preliminary Paten Publication No. 60-94629/1985 discloses a method which comprises performing initial winding of a yarn on an empty bobbin to form yarn underwindings at the re-start of a machine after changing a completed yarn package to the empty bobbin, thereafter temporarily terminating the machine, pulling up the bobbin slightly from a spindle to separate a yarn interconnecting the yarn underwindings with the bobbin, putting back the bobbin in its regular position, and then starting the machine to cast off the yarn underwindings by rotational centrifugal force of the spindle. According to this method, however, the temporary termination of the machine reduces operation efficiency and yarn breakage is liable to occur at the re-start of the machine.

An object of the present invention is to solve such problems of the prior art to provide an apparatus for treating a tail yarn in which the tail yarn can be securely fixed on the base portion of the spindle and completely removed therefrom without yarn breakage and the occurrence of fluffs during operation of the machine.

SUMMARY OF THE INVENTION

According to the present invention, there is provided an apparatus for treating a tail yarn in a textile spindle assembly which comprises an upper slit ring fixedly mounted on a base portion of a spindle, a cylindrical member having a lower slit ring at an upper end thereof and a lower portion outwardly expandable by centrifugal force, and a guiding surface fixed on a lower part of said base portion of the spindle, a flange of said upper slit ring being preferably perforated with a plurality of yarn passing openings, said cylindrical member being axially slidably fitted on said base portion of the spindle beneath said upper slit ring, said cylindrical member being mounted so that a lower end of the expandable portion thereof capably comes into contact with said guiding surface, said upper slit ring and said lower slit ring being pressed together to form a tail yarn gripping means, whereby expansion of said lower portion of said cylindrical member by centrifugal force causes said cylindrical member to slide axially downward to release a pressed state between said upper slit ring and said lower slit ring.

DESCRIPTION OF THE PREFERRED EMBODIMENTS

Apparatus of the present invention will hereinafter be described according to the drawings.

Figure 1:
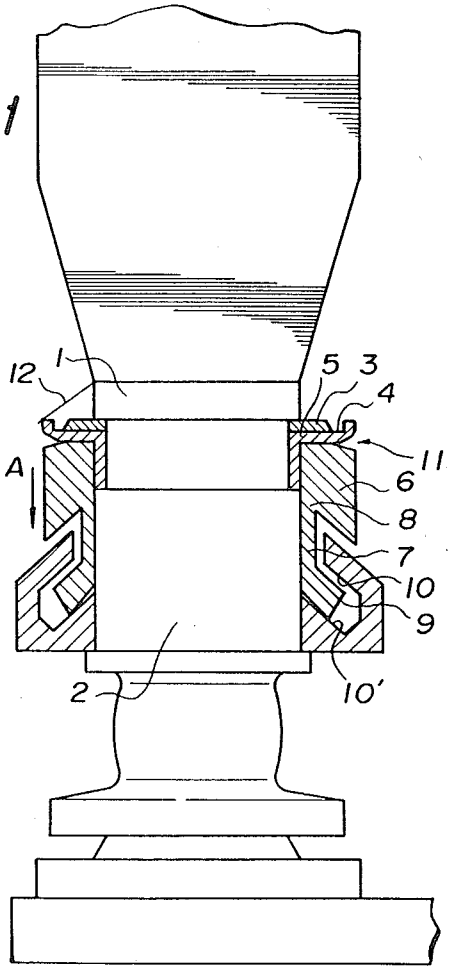
FIG. 1 is a sectional side view showing an embodiment of the present invention.

FIG. 1 is a sectional side view showing an embodiment of the present invention. An upper slit ring 5 having a ring-like cutter 3 and a flange 4 is securely fixed on an upper part of a base portion of a spindle 2 on which a bobbin 1 is mounted. In FIG. 1, a cylindrical member 8 having a lower slit ring 6 at an upper end thereof and a lower portion 7 outwardly expandable by centrifugal force is axially slidably fitted on the base portion 2 of the spindle beneath the upper slit ring 5. The cylindrical member 8 is mounted so that a lower end 9 of the expandable portion (lower portion) 7 thereof capably comes into contact with a guiding surface 10 fixed on the base portion 2 of the spindle. The upper slit ring 5 and the lower slit ring 6 are pressed together to form a tail yarn gripping means 11. When the spindle rotates and the lower portion 7 of the cylindrical member 8 is outwardly expanded by centrifugal force of the spindle, the lower end 9 comes into contact with the stationary guiding surface 10, which causes the cylindrical member 8 to slide axially downward (in the direction of the arrow) to release a pressed state between the upper slit ring 5 and the lower slit ring 6. Numeral 12 shows an interconnecting yarn formed between the tail yarn gripping means 11 and a bobbin 1. An undersurface of the upper slit ring 5 may be flat, instead of the curved surface as shown in FIG. 1. When the upper slit ring 5 and the lower slit ring 6 are pressed together, a sufficient pressed state can be obtained by arranging the cylindrical member 8 so that the lower end 9 comes into contact with a lower part 10' of the stationary guiding surface to press upward the cylindrical member 8 in a state where the lower portion 7 of the cylindrical member does not expand outwardly. The slit rings 5 and 6 may be pressed together by using a pressing means such as a spring or magnetic force, as needed.

Figure 2:
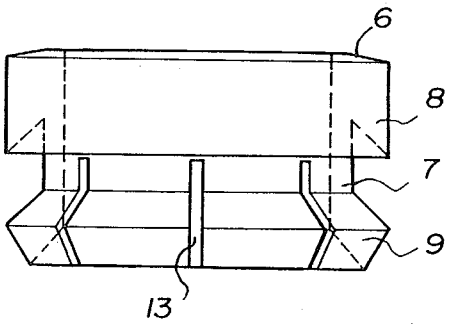
FIG. 2 is a side view showing an embodiment of a cylindrical member used in the present invention.

As shown in FIG. 2, the upper end of the cylindrical member 8 constitutes the lower slit ring 6, and the lower portion 7 thereof is split by plural slits 13 so as to be outwardly expanded by centrifugal force. The lower end 9 of the lower portion 7 is not limited to a polygonal shape as shown in FIG. 2, but may have any shape such as a circular or a elliptic shape. The cylindrical member 8 may be composed of any material such as metal or plastic, as long as the material has such elasticity that the lower portion 7 thereof is outwardly expanded by centrifugal force. By suitable selection of the material of the cylindrical member 8, the thickness of the lower portion 7, the number of the slits 13 and the like, the cylindrical member 8 can be downward slided at a desired rotation speed, and thereby the pressed state between the upper slit ring 5 and the lower slit ring 6 can be released. The stationary guiding surface 10 may be constituted integrally with the base portion 2 of the spindle or fixed thereto with screws or the like. Further, the guiding surface 10 may be pressed into the base portion 2.

Figure 4:
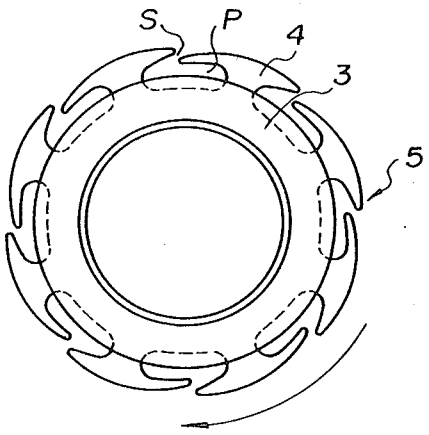
FIG. 4 is a top plan view showing an upper slit ring of FIG. 3.
Figure 3:
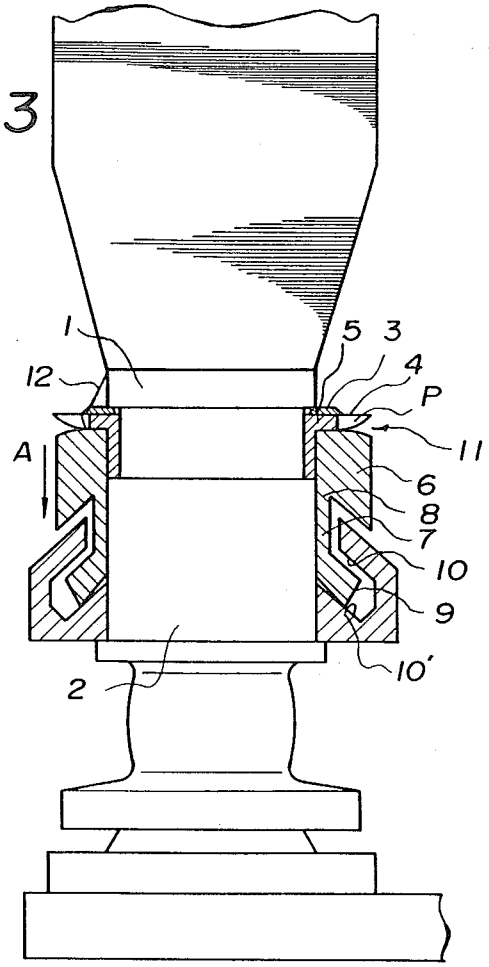
FIG. 3 is a sectional side view showing another embodiment of the present invention.

In case of the apparatus shown in FIG. 1, when the pressed state between the upper slit ring 5 mounted on the base portion 2 of the spindle and the lower slit ring 6 is released, the interconnecting yarn (tail yarn) 12 released from the tail yarn gripping means 11 is horizontally swung by rotational centrifugal force of the spindle to come into contact with a traveler fitted on a traverse ring, whereby the position of the traveler is disordered, which sometimes causes the occurrence of yarn breakage. Further, the released yarn is sometimes wound into the package together with the yarn which is being wound on the bobbin, resulting in the deterioration of yarn properties. For solving these problems, the flange 4 of the upper slit ring 5 is preferably perorated with a plurality of yarn passing openings P, as shown in FIGS. 3 and 4. In FIG. 3, the same parts as in FIG. 1 are designated by the same numerals as in FIG. 1, and the descriptions thereof are omitted.

FIG. 4 is a top plan view showing the upper slit ring 5. The flange 4 thereof is perforated with a plurality of yarn passing openings P. The number of the yarn passing openings is not particularly limited, but about 6 to 10 openings are usually suitable. The shape of the yarn passing opening is preferably elliptic as shown in FIG. 4. However, the openings are not particularly limited to a elliptic shape, but may have any shape.

Further, on an outer periphery of the yarn passing opening P is formed a yarn introducing slit S inclined to the direction opposite to that of rotation of the spindle. This slit S is formed in such a shape and dimensions that the yarn once introduced therein does not jump out thereof.

In FIG. 4, a ring cutter 3 is mounted on the upper slit ring 5. However, a cutter may be formed on an inner periphery of the yarn passing opening P, instead of the ring cutter 3. An undersurface of the upper slit ring 5 may be flat, instead of the curved surface as shown in FIG. 3.

Then, the operation of the apparatus of the present invention, when the apparatus shown in FIG. 3 is used, will hereinafter be described in accordance with FIGS. 5 to 8. In FIGS. 5 to 8, the same parts as in FIG. 3 are designated by the same numerals as in FIG. 3, and the descriptions thereof are omitted.

Figure 5:
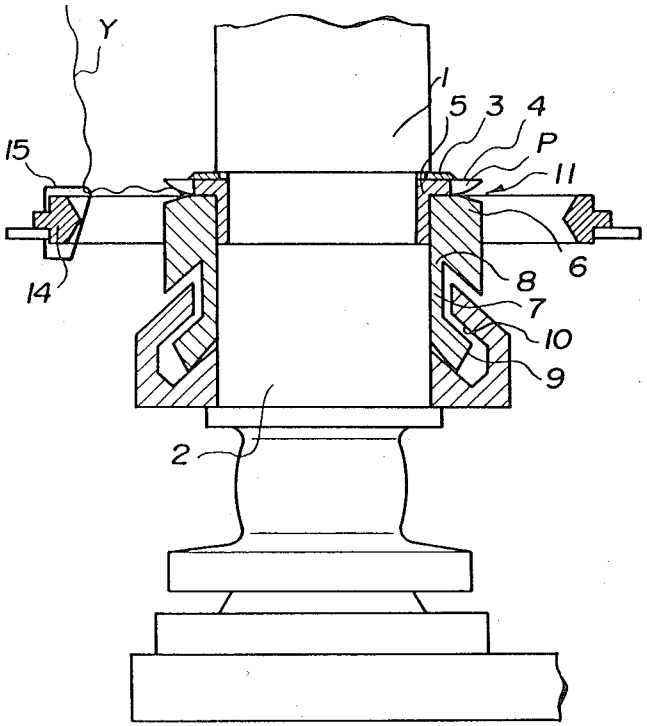
Figure 8:
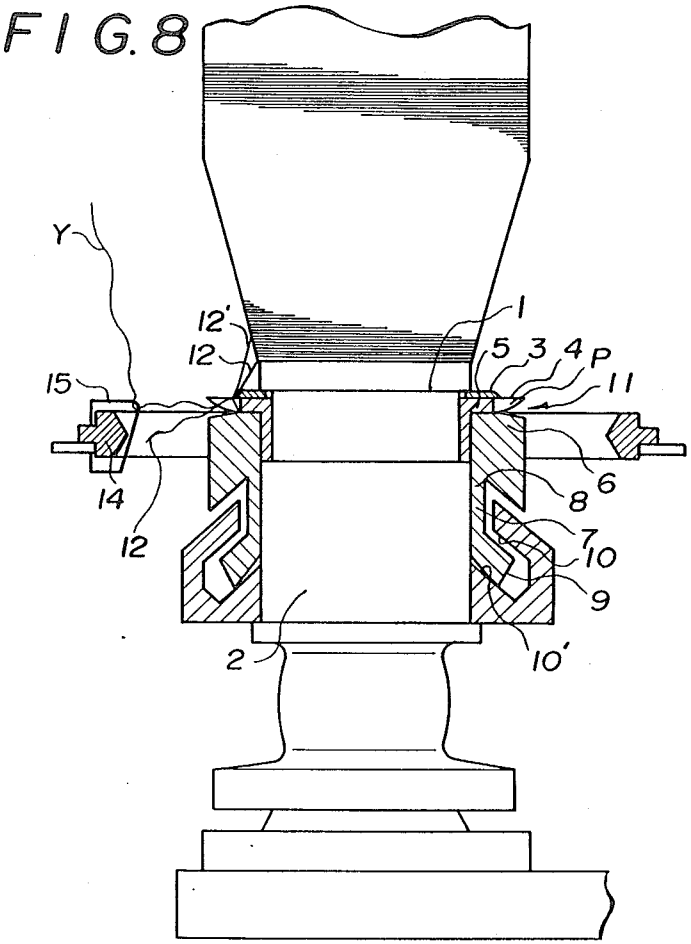

FIG. 5 shows a state just before the start of winding in a textile spindle assembly of the spinning machine, wherein the cylindrical member 8 is upward pressed and the lower slit ring 6 is pressed to the upper slit ring 5 to form the tail yarn gripping means 11. A yarn Y fed from the roller part (not shown in the drawings) of the spinning machine is passed through the traveler 15 fitted on the traverse ring 14 and held to the tail yarn gripping means 11 by wrapping its end about half to one turn thereon.

Figure 6:
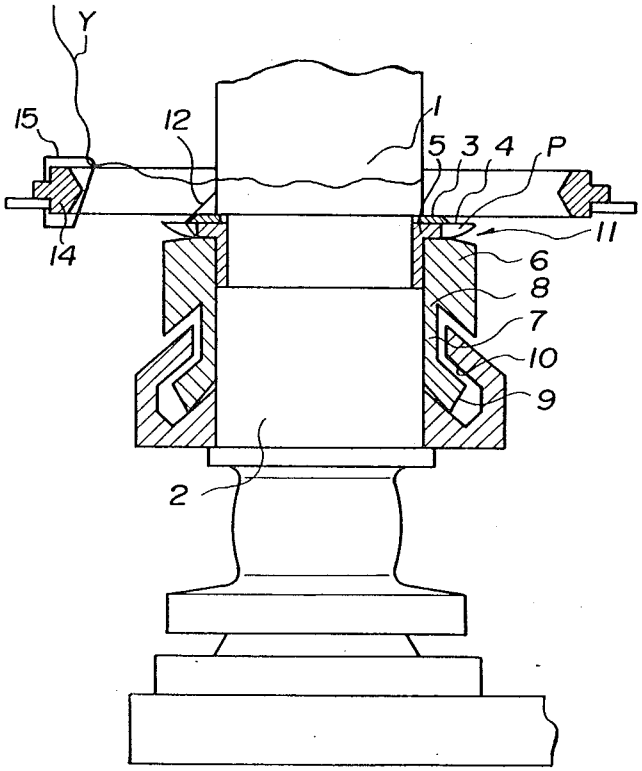
FIGS. 5 to 8 are sectional side views for illustrating operation of an apparatus of the present invention.
Figure 7:
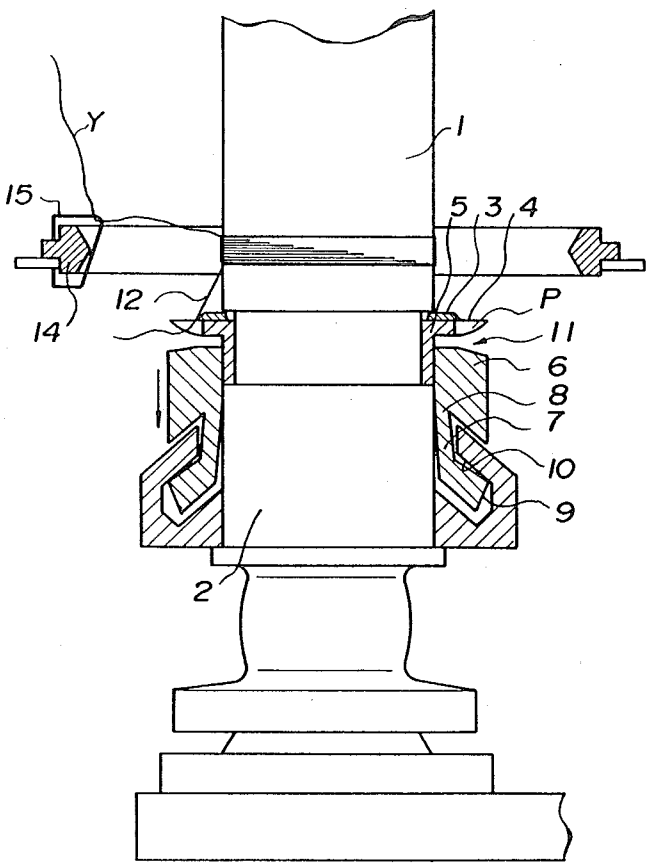

Then, on the start of winding, the traverse ring 14 is raised to the winding position of the bobbin 1 as shown in FIG. 6. In this case, when the yarn Y comes into contact with the outer periphery of the upper slit ring 5, the yarn enters the yarn passing opening P through the yarn introducing slit S shown in FIG. 4 to form the interconnecting yarn (tail yarn) 12 between the tail yarn gripping means 11 an the bobbin 1. The traverse ring 14 reciprocates within the winding range of the bobbin 1 to wind the yarn on the bobbin 1 as shown in FIG. 7.

Subsequently, when the rotation of the spindle 2 is increased to a determined speed, the lower portion 7 of the cylindrical member 8 is outwardly expanded by centrifugal force. As a result, the ower end 9 comes into contact with the stationary guiding surface 10. Thereupon, the movement of the lower end 9 is restricted by the stationary guiding surface 10. Therefore, further addition of centrifugal force lowers the cylindrical member 8 automatically downward (in the direction of the arrow), resulting in the release of the pressed state of the tail yarn gripping means 11. Thus, the yarn underwindings which have been held by the means 11 is released for removal from the tail yarn gripping means 11 by centrifugal force of the spindle 2.

In this case, the interconnecting yarn (tail yarn) 12 released from the tail yarn gripping means 11 is retained in the yarn passing opening P. Consequently, it does not happen that the interconnecting yarn (tail yarn) 12 is horizontally swung to come into contact with the traveler 15 or to be wound into the package together with the yarn which is being wound on the bobbin. Therefore, the yarn breakage and the deterioration of yarn properties ar not induced.

When the yarn package building on the bobbin 1 is completed, the traverse ring 14 is lowered again to the position corresponding to the tail yarn gripping means 11, and the tail yarn is held by the tail yarn gripping means 11. At the time, the previous yarn underwindings have been completely released for removal from the tail yarn gripping means 11, and the lower portion 7 of the cylindrical member 8 has returned to the initial state from the expanded state, with a decrease of rotation speed of the spindle 2. Consequently, the lower end 9 has come into contact with the lower stationary guiding surface 10' to press the cylindrical member 8 upward, and thereby the tail yarn gripping means 11 has returned to the pressed state. Therefore, the yarn underwindings are very firmly held by the tail yarn gripping means 11. When the traverse ring 14 is lowered to the position corresponding to the tail yarn gripping means 11, the yarn comes into contact with the outer periphery of the upper slit ring 5 rotating at a low speed and enters the yarn passing opening P through the yarn introducing slit S shown in FIG. 4 to form a connecting yarn 12' in contact with the cutter 3.

After the rotation of the spindle is terminated, the completed yarn package is pulled up by an auto-doffer. At that moment, the connecting yarn 12' formed with the traverse ring 14 is lowered to the position corresponding to the tail yarn gripping means 11 is pressed onto the cutter 3 in its stretched condition and separated thereby.

Then the completed yarn package is pulled out of the spindle, whereupon the interconnecting yarn (tail yarn) 12 retained in the yarn passing opening P of the upper slit ring 5 is also simultaneously pulled out of the yarn passing opening P.

By repetition of the procedures described above, the doffing operation can be automatically achieved.

If the interconnecting yarn (tail yarn) 12 released from the tail yarn gripping means 11 is too long, when the leading end of the yarn fully wound on the bobbin is taken out by an air suction device in the subsequent procedures, there occurs the trouble that this interconnecting yarn (tail yarn) 12 is also sucked together therewith to reduce operation efficiency.

Figure 9:
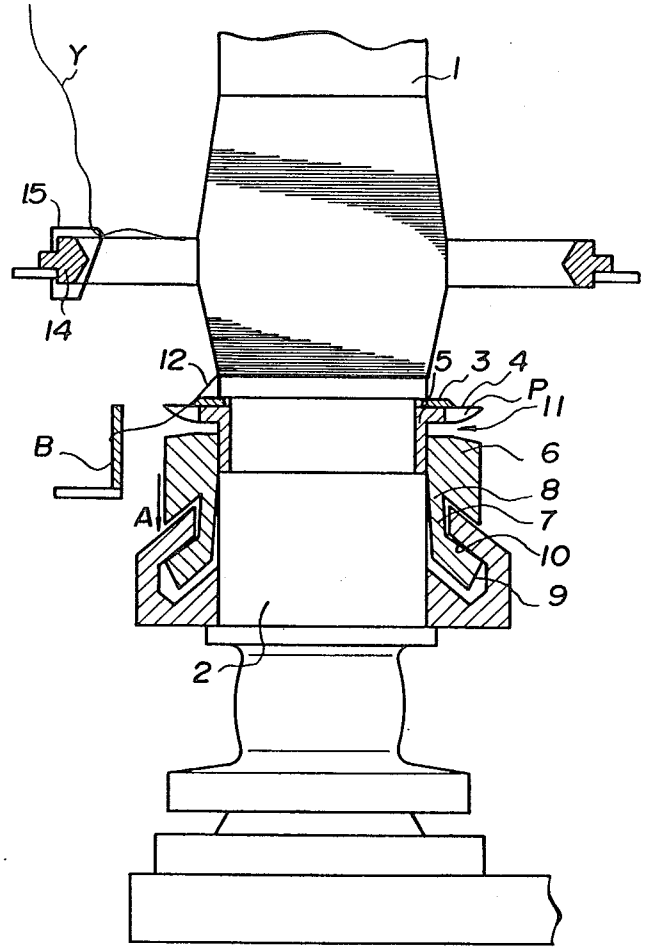
FIG. 9 is a sectional side view further showing another embodiment of the present invention.

In case of spun yarn composed of relatively short fibers, there is no particular problem, because the interconnecting yarn (tail yarn) 12 is teared off during rotation by rotational centrifugal force of the spindle to be shortened. However, in case of filament yarn or spun yarn composed of long fibers, the interconnecting yarn (tail yarn) 12 can not be teared off by rotational centrifugal force and the initial length of the tail yarn is sometimes not shortened, which causes the problem of reduction of operation efficiency described above. On that occasion, it is preferable, as shown in FIG. 9, to mount a yarn breaking means B at the position where the interconnecting yarn (tail yarn) 12 released from the tail yarn gripping means 11 is swung by rotational centrifugal force and to bring the interconnecting yarn (tail yarn) 12 being swung into contact with the yarn breaking means B, whereby the interconnecting yarn (tail yarn) 12 is teared off to be shortened. As the yarn breaking means B, there may be used a rod-like member of any configuration. Particularly, a file-like edged tool is preferably used. The yarn breaking means B may be arranged so as to move up and down, interlocked with movement of the ring. For example, the yarn breaking means B can be pressed upward to the operating position during its operation by a spring mounted on a lower portion thereof, and pressed downward by the ring rail so as to be kept separate from the operating position when the ring rail goes down.

According to the present invention, the tail yarn can be securely held and the doffing operation can be automatically carried out without failure, because of use of the tail yarn gripping means formed by a pair of slit rings pressed together. Further, when the flange of the upper slit ring is perforated with a plurality of yarn passing openings, the tail yarn released from the means for holding the yarn underwindings is retained by this yarn passing opening, which prevents adverse effects to the traveler in the early stage of winding and the occurrence of yarn breakage or deteriorated yarn properties.

I claim:

1. An apparatus for treating a tail yarn in a textile spindle assembly which comprises an upper slit ring fixedly mounted on a base portion of the spindle, a cylindrical member having a lower slit ring at an upper end thereof and a lower portion outwardly expandable by centrifugal force, and a guiding surface fixed on a lower part of said base portion of the spindle, said cylindrical member being axially slidably fitted on said base portion of the spindle beneath said upper slit ring, said cylindrical member being mounted so that a lower end of the expandable portion thereof capably comes into contact with said guiding surface, said upper slit ring and said lower slit ring being pressed together to form a tail yarn gripping means, whereby expansion of said lower portion of said cylindrical member by centrifugal force causes said cylindrical member to slide axially downward to release a pressed state between said upper slit ring and said lower slit ring.

2. The apparatus according to claim 1, wherein a flange of said upper slit ring is perforated with a plurality of yarn passing openings.

3. The apparatus according to claim 2, wherein a yarn introducing slit inclined to a direction opposite to that of rotation of the spindle is formed on an outer periphery of said yarn passing opening.

4. The apparatus according to claim 1, 2 or 3, wherein a yarn breaking means is mounted at a position where the tail yarn released from the tail yarn gripping means is swung by centrifugal force.

* * * * *